US010886620B2

(12) United States Patent
Obata et al.

(10) Patent No.: US 10,886,620 B2
(45) Date of Patent: Jan. 5, 2021

(54) ANTENNA

(71) Applicant: Panasonic Intellectual Property Management Co., Ltd., Osaka (JP)

(72) Inventors: Masayuki Obata, Miyagi (JP); Yu Ono, Miyagi (JP); Hironori Kikuchi, Miyagi (JP); Shingo Sumi, Miyagi (JP); Hiroaki Ohmori, Miyagi (JP); Akira Kanazawa, Tokyo (JP); Katsuhiko Morioka, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/504,512

(22) Filed: Jul. 8, 2019

(65) Prior Publication Data

US 2019/0334246 A1 Oct. 31, 2019

Related U.S. Application Data

(63) Continuation of application No. PCT/JP2018/000604, filed on Jan. 12, 2018.

(30) Foreign Application Priority Data

Jan. 18, 2017 (JP) ..... 2017-007038
Jan. 18, 2017 (JP) ..... 2017-007039
Jan. 18, 2017 (JP) ..... 2017-007040

(51) Int. Cl.
*H01Q 1/38* (2006.01)
*H01Q 13/08* (2006.01)
(Continued)

(52) U.S. Cl.
CPC ..... *H01Q 13/08* (2013.01); *H01Q 1/38* (2013.01); *H01Q 1/52* (2013.01); *H01Q 9/045* (2013.01);
(Continued)

(58) Field of Classification Search
CPC ..... H01Q 13/08; H01Q 1/38; H01Q 1/52; H01Q 9/045; H01Q 9/065; H01Q 19/005; H01Q 19/02
See application file for complete search history.

(56) References Cited

U.S. PATENT DOCUMENTS

2012/0139793 A1 6/2012 Sharawi
2013/0050037 A1 2/2013 Takemura et al.
(Continued)

FOREIGN PATENT DOCUMENTS

JP 2008-219574 9/2008
JP 2009-246460 10/2009
(Continued)

OTHER PUBLICATIONS

International Search Report of PCT application No. PCT/JP2018/000604 dated Mar. 13, 2018.

*Primary Examiner* — Dameon E Levi
*Assistant Examiner* — David E Lotter
(74) *Attorney, Agent, or Firm* — Greenblum & Bernstein, P.L.C.

(57) ABSTRACT

An antenna includes a dielectric substrate, a ground element, a feed element, a microstrip line, and a feed point. The ground element is disposed on a first surface of the dielectric substrate. The ground element includes a slit. The feed element is disposed on a second surface of the dielectric substrate. The microstrip line extends from the feed element toward the slit. The feed point is disposed on the second surface of the dielectric substrate, and connected to the feed element via the microstrip line. The feed point is positioned between the feed element and the slit, and disposed at an end of the microstrip line.

13 Claims, 12 Drawing Sheets

(51) Int. Cl.

| | |
|---|---|
| ***H01Q 1/52*** | (2006.01) |
| ***H01Q 9/04*** | (2006.01) |
| ***H01Q 9/06*** | (2006.01) |
| ***H01Q 19/00*** | (2006.01) |
| ***H01Q 19/02*** | (2006.01) |

(52) U.S. Cl.
CPC ..... *H01Q 9/065* (2013.01); *H01Q 19/005* (2013.01); *H01Q 19/02* (2013.01)

(56) References Cited

U.S. PATENT DOCUMENTS

| | | | | |
|---|---|---|---|---|
| 2015/0236420 | A1 | 8/2015 | Iino | |
| 2018/0123261 | A1* | 5/2018 | Sano | H01Q 21/0087 |

FOREIGN PATENT DOCUMENTS

| | | |
|---|---|---|
| JP | 2012-120150 | 6/2012 |
| JP | 2015-146552 | 8/2015 |

* cited by examiner

| Wavelength | Length [mm] |
|---|---|
| λ/24 | 1.0 |
| λ/20 | 1.2 |
| λ/12 | 1.5 |
| λ/10 | 2.0 |
| λ/8 | 3.0 |
| λ/6 | 4.0 |
| λ/5 | 4.8 |

ANTENNA

CROSS-REFERENCE TO RELATED APPLICATIONS

This application is a U.S. national stage application of the PCT International Application No. PCT/JP2018/000604 filed on Jan. 12, 2018, which claims the benefit of foreign priority of Japanese patent application No. 2017-007038 filed on Jan. 18, 2017, Japanese patent application No. 2017-007039 filed on Jan. 18, 2017 and Japanese patent application No. 2017-007040 filed on Jan. 18, 2017, the contents all of which are incorporated herein by reference.

BACKGROUND

1. Technical Field

The present disclosure relates to an antenna technique, and particularly relates to an antenna including a feed element disposed on a dielectric substrate.

2. Description of the Related Art

A microstrip antenna is an example of a small-sized antenna. For controlling directivity of the microstrip antenna, a plurality of passive elements are disposed around respective sides of the microstrip antenna having a substantially rectangular shape. An electrical length of each of the passive elements is set in accordance with desired directivity (for example, refer to Japanese Unexamined Patent Publication No. 2012-120150).

SUMMARY

When a clearance between the microstrip antenna and each of the passive elements is long, an effect of gain improvement decreases even with arrangement the passive elements.

In consideration of the aforementioned circumstances, the present disclosure provides a technique for improving antenna characteristics.

An antenna according to an aspect of the present disclosure includes a dielectric substrate, a ground element, a feed element, a microstrip line, and a feed point. The ground element is disposed on a first surface of the dielectric substrate. The ground element includes a slit. The feed element is disposed on a second surface of the dielectric substrate. The microstrip line extends from the feed element toward the slit. The feed point is disposed on the second surface of the dielectric substrate, and connected to the feed element via the microstrip line. The feed point is positioned between the feed element and the slit, and disposed at an end of the microstrip line.

According to the present disclosure, improvement of antenna characteristics is achievable.

DETAILED DESCRIPTION OF PREFERRED EMBODIMENTS

Figure 1A:
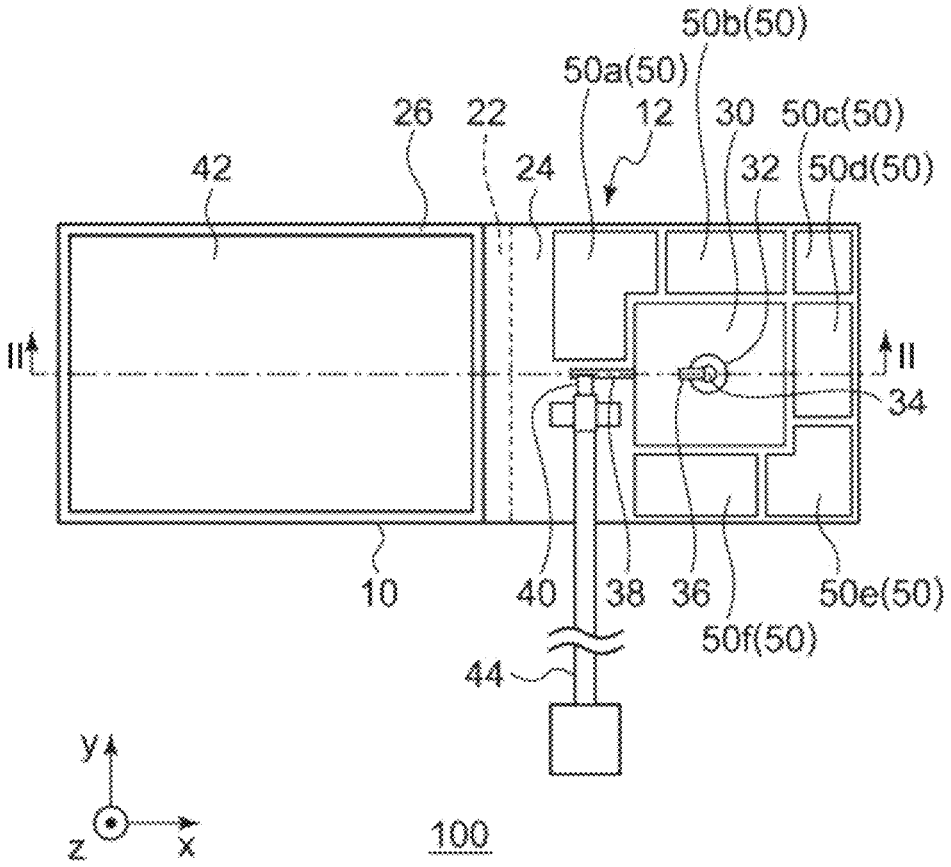
FIG. 1A is a plan view showing a structure of a front surface of an antenna according to an exemplary embodiment of the present disclosure.

Before specifically describing an exemplary embodiment of the present disclosure, an outline of the present exemplary embodiment is touched upon. An antenna according to the present exemplary embodiment includes a dielectric substrate, a feed element disposed on a front surface of the dielectric substrate, and a ground element disposed on a rear surface of the dielectric substrate. For example, the antenna is a microstrip antenna included in an electronic toll collection system (ETC) on-vehicle device. The microstrip antenna has a resonance frequency in a band of 5.8 GHz, for example. An object of the present exemplary embodiment is to improve antenna characteristics (antenna gain and antenna efficiency). Specifically, this object is explained in view of at least one of following points (1) to (3).

(1) The antenna includes a notification circuit which notifies the ETC on-vehicle device about establishment of connection between the antenna and the ETC on-vehicle device. When the notification circuit is disposed near a microstrip line connecting the feed element and a feed point, input impedance starting from the feed point is affected by the notification circuit. In this case, mismatch loss increases, and antenna gain lowers. When the notification circuit is disposed around an external edge of the feed element corresponding to a radiation source, antenna characteristics deteriorate as described above. According to the present exemplary embodiment, a hole is formed near a central portion of the feed element. The notification circuit is disposed at a position surrounded by the feed element. In this case, the effects caused to the input impedance decreases, wherefore antenna characteristics improve.

(2) When a clearance between the feed element and each of a plurality of passive elements, which are parasitic elements disposed around the feed element, is long, an improvement effect of antenna gain decreases. Accordingly, the clearance between the feed element and each of the passive elements needs to be reduced by a certain amount. However, when the clearance is reduced, the passive elements also resonate at a resonance frequency. In this case, an effective resonance frequency lowers by electromagnetic coupling between the passive elements and the feed element. As a result, antenna gain at a desired resonance frequency lowers. According to the present exemplary embodiment, the feed element is sized such that a resonance frequency of the feed element becomes higher than a desired resonance frequency. The plurality of passive elements are disposed with a reduced clearance between the feed element and each of the passive elements by a certain amount. As a result, an effective resonance frequency becomes a frequency near the desired band, wherefore antenna gain at the desired resonance frequency improves.

(3) In general, the feed element is so disposed as to overlap with a central portion of the ground element. This arrangement is adopted to produce antenna directivity toward the zenith by diffraction of a radio wave, which is radiated by the feed element, at a uniform distance from an end of the ground element. In consideration of this point, it is preferable that the dielectric substrate has a substantially square shape. However, when an electric circuit other than the feed element is mounted on a surface of the dielectric substrate, the dielectric substrate has a substantially rectangular shape rather than a substantially square shape. When the ground element has a substantially rectangular shape similarly to the portion on which the electric circuit is mounted, the distance from an antenna element to the ground element becomes non-uniform. This non-uniformity generates components cancelling each other in phase. As a result, a directivity pattern described above collapses, wherefore antenna gain in the zenith direction lowers. According to the present exemplary embodiment, a ground potential is divided into a first ground element and a second ground element by a slit formed in the ground element. The first ground element has a substantially square shape. The feed element overlaps with a central portion of the first ground element. A feed point is disposed on the slit side. In this case, a current flowing in a longitudinal direction of the dielectric substrate decreases, wherefore the foregoing directivity pattern does not easily collapse.

In the following description, the terms "parallel" and "orthogonal" are assumed to include not only a perfectly parallel state and a perfectly orthogonal state, but also a state deviated from a parallel or orthogonal state within tolerance. Specifically, the term "parallel" means a state that an angle formed by two lines is in a range not exceeding 5°, while the term "orthogonal" means a state that an angle formed by two lines is in a range between 85° and 95° (inclusive). In addition, the term "substantially" means a state approximately identical.

Figure 1B:
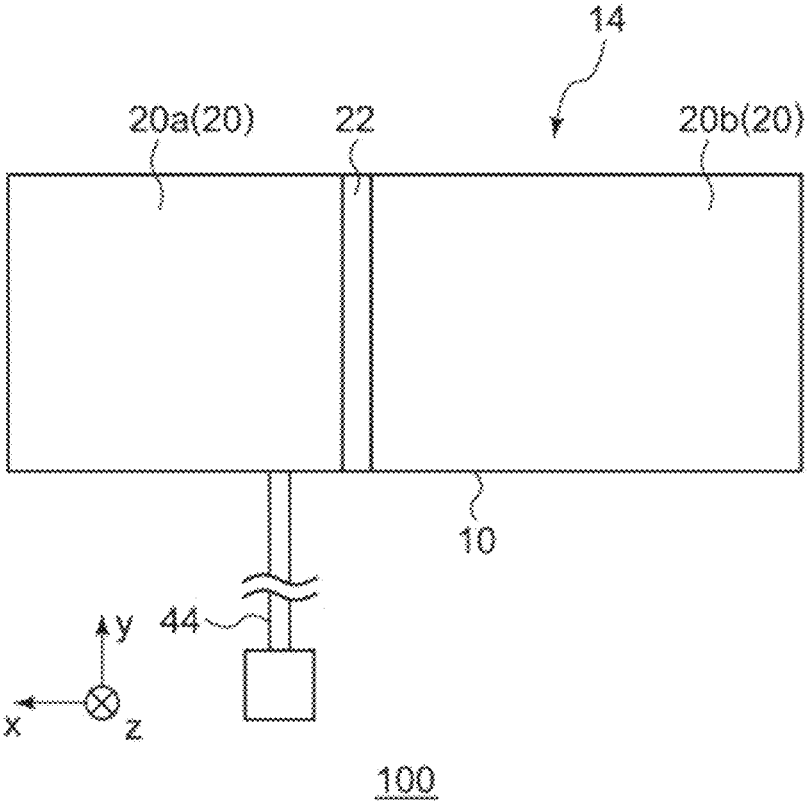
FIG. 1B is a plan view showing a structure of a rear surface of the antenna shown in FIG. 1A.
Figure 2:
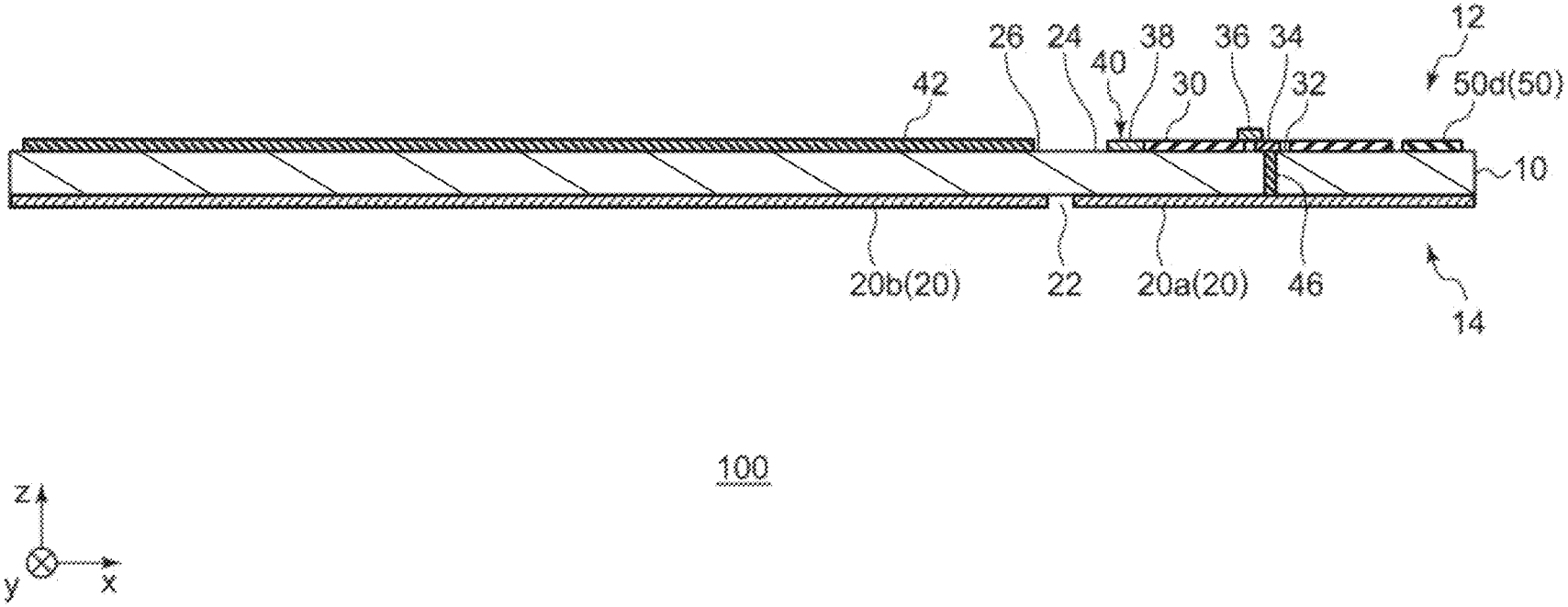
FIG. 2 is a cross-sectional view of the antenna taken along a line II-II shown in FIG. 1A.

FIG. 1A and FIG. 1B are plan views each showing a structure of antenna 100 according to the present exemplary embodiment. FIG. 2 is a cross-sectional view of antenna 100 taken along a line II-II shown in FIG. 1A. An orthogonal coordinate system which has an X axis, a Y axis, and a Z axis is defined as shown in FIGS. 1A, 1B, and 2. The X axis and the Y axis cross each other at right angles in a plane of antenna 100. The Z axis is perpendicular to the X axis and the Y axis. The positive direction of each of the X axis, Y axis, and Z axis is defined as a direction of a corresponding arrow in FIG. 1A, FIG. 1B, and FIG. 2, while the negative direction of each of the axes is defined as a direction opposite to the corresponding arrow. Antenna 100 has two main surfaces parallel to an x-y plane. In these main surfaces, the main surface disposed on the positive side in the Z axis direction is front surface 12, while the main surface disposed on the negative side in the Z axis direction is rear surface 14. When rear surface 14 is referred to as a first surface, front surface 12 is referred to as a second surface.

Antenna 100 includes dielectric substrate 10, first ground element 20*a*, second ground element 20*b*, slit 22, feed element 30, land 34, circuit section 36, microstrip line 38, feed point 40, electric circuit section 42, first passive element 50*a*, second passive element 50*b*, third passive element 50*c*, fourth passive element 50*d*, fifth passive element 50*e*, and sixth passive element 50*f*. Each of first ground element 20*a* and second ground element 20*b* is collectively referred to as ground element 20. Each of first passive element 50*a*, second passive element 50*b*, third passive element 50*c*, fourth passive element 50*d*, fifth passive element 50*e*, and sixth passive element 50*f* is collectively referred to as passive element 50. The number of passive elements 50 is not limited to "6". Hole 32 is formed in feed element 30. Land 34 is formed on the inside of hole 32 and disposed on dielectric substrate 10.

Dielectric substrate 10 has a rectangular plate shape which is longer in the X axis direction than in the Y axis direction. The two main surfaces of dielectric substrate 10 constitute front surface 12 and rear surface 14. First ground element 20*a* is disposed on rear surface 14 of antenna 100 on the positive side in the X axis direction. First ground element 20*a* has a substantially square shape. Second ground element 20*b* is disposed on rear surface 14 of antenna 100 on the negative side in the X axis direction. Slit 22 is formed between first ground element 20*a* and second ground element 20*b*. Slit 22 is formed in ground element 20. Dielectric substrate 10 is exposed through slit 22. In this manner, second ground element 20*b* is separated from first ground element 20*a* with slit 22 located at a boundary between first and second ground elements 20*a* and 20*b*. Accordingly, a ground potential of first ground element 20*a* is different from a ground potential of second ground element 20*b*.

A portion included in front surface 12 and corresponding to an overlapping portion between dielectric substrate 10 and first ground element 20*a* is defined as first region 24, while a portion included in front surface 12 and corresponding to an overlapping portion between dielectric substrate 10 and second ground element 20*b* is defined as second region 26. Accordingly, first region 24 and second region 26 are also separated from each other with slit 22 located at a boundary between first and second regions 24 and 26. Feed element 30 having a substantially square shape is disposed on front surface 12 near a central portion of first region 24 of dielectric substrate 10. Accordingly, feed element 30 is disposed on a projection surface parallel to front surface 12 or rear surface 14 (hereinafter simply referred to as "projection surface"), and overlaps with first ground element 20*a*. Feed element 30 is also referred to as a microstrip antenna or a patch antenna in some cases.

Hole 32 is disposed near a central portion on the inside of feed element 30, while land 34 is disposed near a central portion on the inside of hole 32. Land 34 is a conductor having a cylindrical shape, and has a Z-axis height close to a thickness of feed element 30. Hole 32 is annularly surrounded by feed element 30. More specifically, feed element 30 has a substantially square external shape, and is opened in a doughnut shape. The shapes of hole 32 and land 34 are not limited to these shapes. Through hole 46 formed by conductor is so disposed as to penetrate dielectric substrate 10 from a surface of land 34 on the negative side in the Z axis direction to a surface of first ground element 20*a* on the positive side in the Z axis direction. Through hole 46 electrically connects first ground element 20*a* and land 34.

Circuit section 36 is disposed between feed element 30 and land 34. Circuit section 36 may have any configuration. When circuit 36 constitutes a notification circuit, for example, a resistance element corresponds to circuit section 36. Circuit section 36 may be a semiconductor, a reactance or the like. Feed element 30 and land 34 are electrically connected by circuit section 36 configured as above. A plurality of passive elements 50 are disposed on front surface 12 around feed element 30. Each of the plurality of passive elements 50 is not required to have a uniform shape.

Microstrip line 38 has a first end and a second end. The first end is connected to an outer edge of feed element 30 on the negative side in the X axis direction. Microstrip line 38 extends from the first end toward slit 22. Feed point 40 is disposed at the second end of microstrip line 38. Specifically, microstrip line 38 extends from feed element 30 toward slit 22. Accordingly, feed point 40 is connected to feed element 30 via microstrip line 38, and disposed between feed element 30 and slit 22. A first end of coaxial cable 44 is connected to feed point 40. For example, a second end of coaxial cable 44 is connected to a not-shown ETC on-vehicle device. This configuration allows feed element 30 to receive power from feed point 40, and antenna 100 to transmit and receive signals of the ETC and to input and output the signals to and from the ETC on-vehicle device via coaxial cable 44.

Electric circuit section 42 having a substantially rectangular shape is disposed in second region 26 of front surface 12 of dielectric substrate 10. Accordingly, electric circuit section 42 is so disposed as to overlap with second ground element 20*b* on the projection surface described above. Any circuit may be adopted as electric circuit section 42. For clarifying the description, a configuration not including the portion of second region 26 is also referred to antenna 100.

A basic structure of antenna 100 has been described above. The structure of antenna 100 is hereinafter described in more detail. Particularly described herein are (1) arrangement of circuit section 36, (2) shapes and positions of feed element 30 and passive elements 50, and (3) structure including second region 26 in this order. Characteristics presented hereinafter are results of simulation.

(1) Arrangement of Circuit Section 36

Figures 3A, 3B:
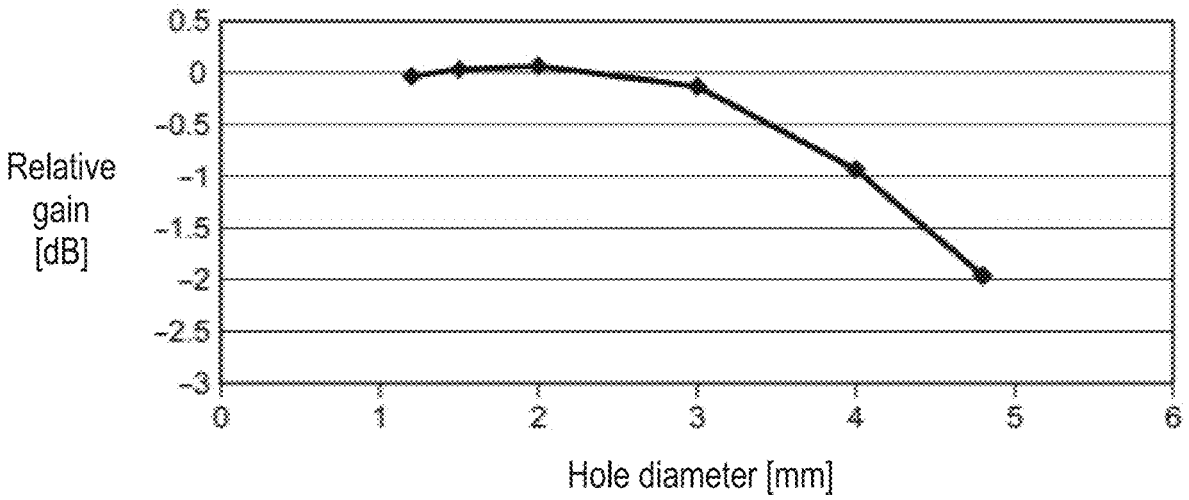
FIG. 3A is a chart showing a change of relative gain of the antenna shown in FIG. 1A with respect to a diameter of a hole.
FIG. 3B is a chart showing a relationship between a wavelength ratio and a length when a resonance frequency of the antenna shown in FIG. 1A is set to a band of 5.8 GHz.

Initially described is a diameter of hole 32 when circuit section 36 is disposed. FIGS. 3A and 3B each show a change of relative gain with respect to the diameter of hole 32. FIG. 3A shows a change of relative gain in accordance with a change of the diameter of hole 32 disposed at a center of feed element 30 in FIG. 1A. The center of feed element 30 is a position connecting a middle point of feed element 30 in the X axis direction and a middle point of feed element 30 in the Y axis direction. In FIG. 3A, a horizontal axis represents a hole diameter, while a vertical axis represents relative gain. As shown in FIG. 3A, relative gain lowers when the hole diameter becomes larger than 3 mm. FIG. 3B shows a relationship between a wavelength ratio and its length when a resonance frequency is set to a band of 5.8 GHz. As apparent from this relationship, the diameter of hole 32 is set to a length less than or equal to ⅛ of a wavelength at a resonance frequency of antenna 100 based on FIG. 3A.

Figure 4:
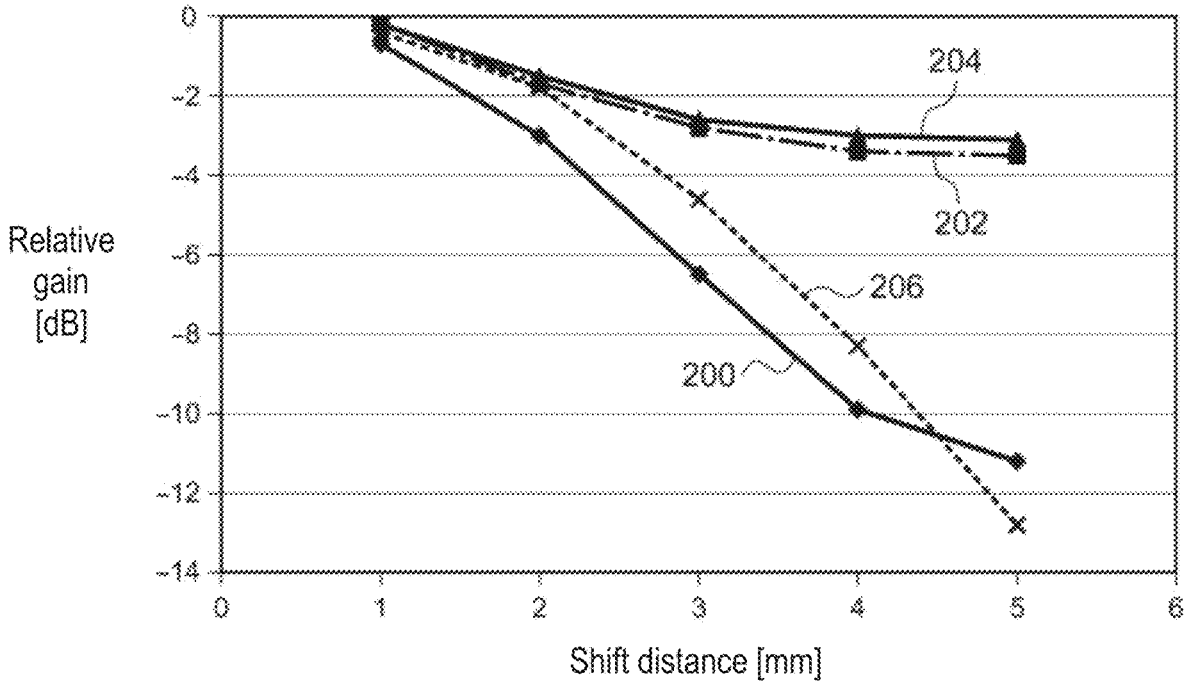
FIG. 4 is a chart showing a change of relative gain of the antenna shown in FIG. 1A with respect to a shift distance of the hole.

Next described is the position of hole 32 when circuit section 36 is disposed. FIG. 4 shows a change of relative gain with respect to a shift distance of hole 32. This change is also considered as a change of relative gain with respect to a shift distance of circuit section 36. In FIG. 4, a change of the relative gain produced when hole 32 shifts to the positive side in the X axis direction (+X axis direction) from the center of feed element 30 in FIG. 1A is indicated by line 200, while a change produced when hole 32 shifts to the negative side in the Y axis direction (−Y axis direction) is indicated by line 202. In addition, a change produced when hole 32 shifts to the positive side in the Y axis direction (+Y axis direction) is indicated by line 204, while a change produced when hole 32 shifts to the negative side in the X axis direction (−X axis direction) is indicated by line 206. Relative gain as a reference is produced when hole 32 is positioned at the center of feed element 30. The relative gain tends to lower as hole 32 or circuit section 36 shifts away from the center. Accordingly, hole 32 is formed within a shift distance up to approximately 1.2 mm from the center of feed element 30, i.e., within a range of a length less than or equal to 1/20 of the wavelength at the resonance frequency of antenna 100.

Figure 5:
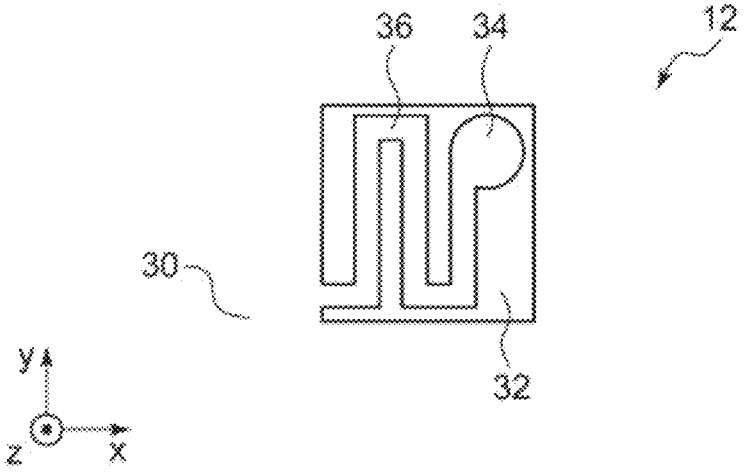
FIG. 5 is a diagram showing a structure example of a circuit section of the antenna shown in FIG. 1A.

Further described is a structure when circuit section 36 is not constituted by a resistance element, a semiconductor element, a reactance or the like. FIG. 5 shows a structure example of circuit section 36 in a partial top view of front surface 12. Circuit section 36 is provided as a stub pattern extending above hole 32 from feed element 30, and connected to land 34. Circuit section 36 in a form of this stub pattern has an inductive reactance component, and therefore has high impedance in a desired frequency band. It is therefore preferable that impedance of circuit section 36 is high.

(2) Shapes and Arrangements of Feed Element 30 and Passive Elements 50

Figure 6:
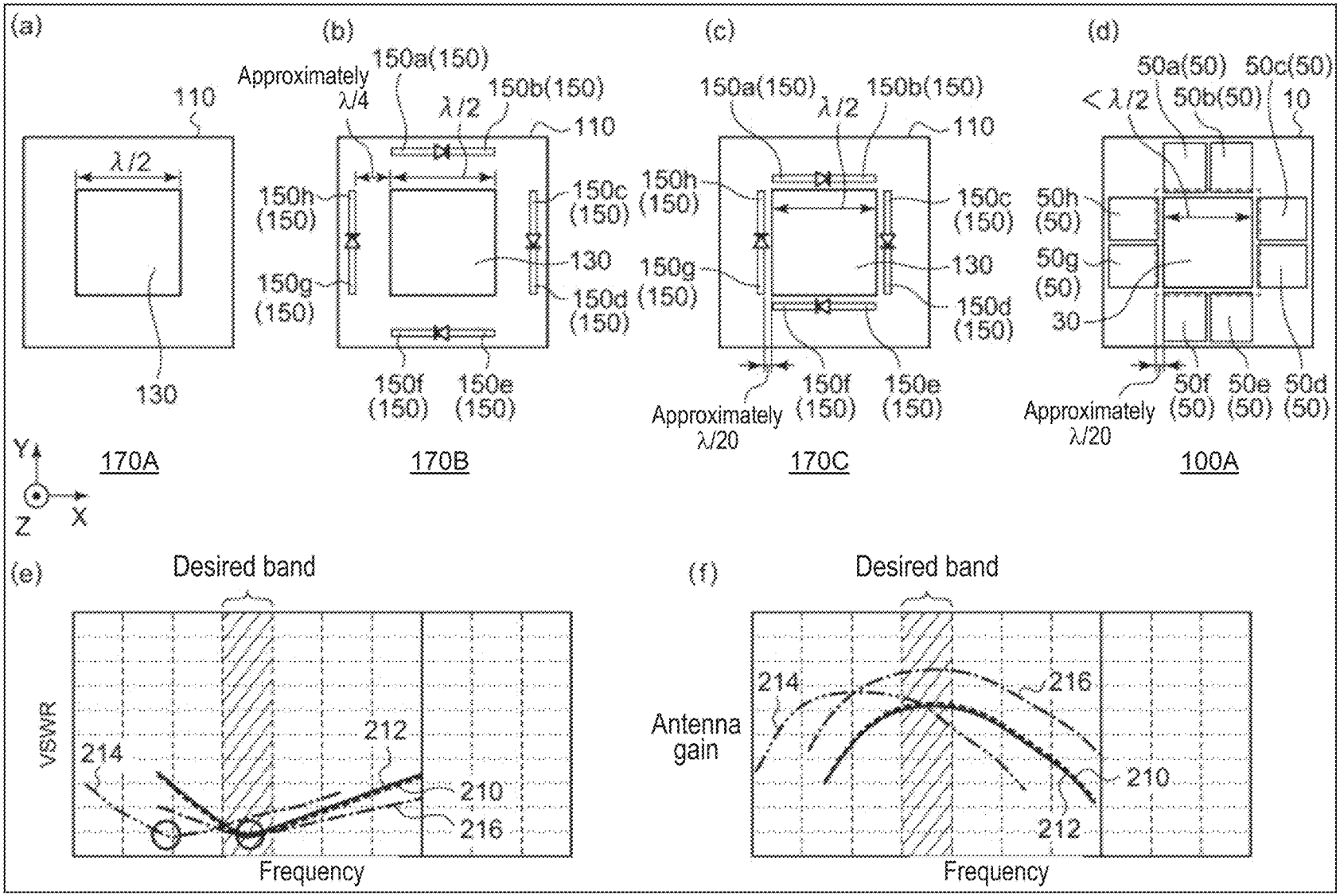
FIG. 6 is a diagram explaining an effect produced by each shape of passive elements of the antenna shown in FIG. 1A.

FIG. 6 shows effects produced by the shape of passive elements 50. Parts (a) to (c) of FIG. 6 are top views showing structures of antenna 170A to 170C, respectively, as comparison targets of antenna 100. Part (d) of FIG. 6 is a top view showing a structure of antenna 100A according to the present exemplary embodiment. Each of parts (a) to (d) of FIG. 6 does not show the part of second region 26 shown in FIG. 1A. Antenna 170A shown in part (a) of FIG. 6 includes feed element 130 disposed at a central portion of dielectric substrate 110. Dielectric substrate 110 and feed element 130 correspond to dielectric substrate 10 and feed element 30 of antenna 100, respectively. An outer edge of feed element 130 in the X axis direction and an outer edge of feed element 130 in the Y axis direction cross each other. A length of at least one of these edges is set to a length of ½ of waveform λ at a resonance frequency of antenna 170A.

Antenna 170B shown in part (b) of FIG. 6 includes a plurality of passive elements 150 disposed around feed element 130 in addition to components of antenna 170A. The plurality of passive elements 150 include first passive element 150*a*, second passive element 150*b*, third passive element 150*c*, fourth passive element 150*d*, fifth passive element 150*e*, sixth passive element 150*f*, seventh passive element 150*g*, and eighth passive element 150*h*. Each of passive elements 150 has such a bar shape that an outer edge facing feed element 130 is longer. Diodes disposed between two passive elements 150 adjacent to each other are electrically insulated from each other. A distance between feed element 130 and each of passive elements 150 is set to a length of approximately ¼ of wavelength λ at a resonance frequency of antenna 170B. In case of antenna 170C shown in part (c) of FIG. 6, a distance between feed element 130 and each of passive elements 150 is set to a length of approximately 1/20 of wavelength λ at a resonance frequency of antenna 170C. Accordingly, the distance between the feed element 130 and each of passive elements 150 in antenna 170C is made smaller than the corresponding distance of antenna 170B. Other configurations of antenna 170C are similar to the corresponding configurations of antenna 170B.

Antenna 100A in part (d) of FIG. 6 is a modification of antenna 100 in FIG. 1A for easy comparison with antenna 170C. In case of antenna 100A, first passive element 50*a* to eighth passive element 50*h*, each collectively referred to as passive element 50, are disposed around feed element 30. An outer edge of feed element 30 in the X axis direction and an outer edge of feed element 30 in the Y axis direction cross each other. A length of at least one of these edges, i.e., at least the length either in the X axis direction or the Y axis direction, is set to a length smaller than a length of ½ of waveform λ at a resonance frequency of antenna 100A. In other words, a length of feed element 30 is smaller than a length of feed element 130 in either the X axis direction or the Y axis direction. Moreover, a length of outer edge of each of passive elements 50 on the side facing feed element 30 is set to a length smaller than a length of feed element 30 in a direction identical to the direction of this outer edge of passive element 50. For example, a length of first passive element 50*a* in the X axis direction is set to a length smaller than ½ of a length of feed element 30 in the X axis direction. A distance between feed element 30 and each of passive elements 50 is set to a length of approximately 1/20 of wavelength λ at a resonance frequency of antenna 100A similarly to antenna 170C.

Part (e) of FIG. 6 shows a change of a voltage standing wave ratio (VSWR) produced when a frequency changes. Antenna characteristics improve as a VSWR decreases. A band including resonance frequencies of antennas 170A to 170C and antenna 100A is indicated as a desired band. Part (f) of FIG. 6 shows a change of antenna gain when a frequency changes. Antenna characteristics improve as antenna gain increases. In parts (e) and (f) of FIG. 6, characteristics 212 of antenna 170B are substantially equivalent to characteristics 210 of antenna 170A. This condition is caused for a following reason. In case of antenna 170B, a distance between feed element 130 and each of passive elements 150 is excessively long. Accordingly, passive elements 150 do not contribute to improvement of characteristics.

Antenna gain in characteristics 214 of antenna 170C improves at a frequency lower than a desired band in comparison with characteristics 210 and 212. However, antenna gain does not improve in the desired band. This condition is caused for a following reason. In a state that the distance between feed element 130 and each of passive elements 150 is short, an effective length of feed element 130 appears to equivalently increase. Accordingly, an effective resonance frequency lowers.

Characteristics 216 of antenna 100A exhibit a low VSWR and improved antenna gain in a desired band in comparison with characteristics 210 to 214. Accordingly, antenna gain improves in the desired band without changing the radiation pattern. Similarly to above, the distance between feed element 30 and each of passive elements 50 of antenna 100A is short, wherefore an effective length of feed element 30 appears to equivalently increase. However, the length of feed element 30 is sized such that a resonance frequency becomes higher than a desired band. Accordingly, feed element 30 resonates in the desired band in the state that passive elements 50 are disposed. In this manner, the length of feed element 30 in the X axis direction or the Y axis direction may be set to a length smaller than ½ of wavelength λ at the resonance frequency of antenna 100. Moreover, the length of the outer edge of each of passive elements 50 on the side facing feed element 30 may be set to a length smaller than the length of feed element 30 in the direction identical to the direction of this outer edge of passive element 50. The length of feed element 30 in the direction identical to the direction of the outer edge is a length of feed element 30 in the direction along the outer edge.

Figure 7:
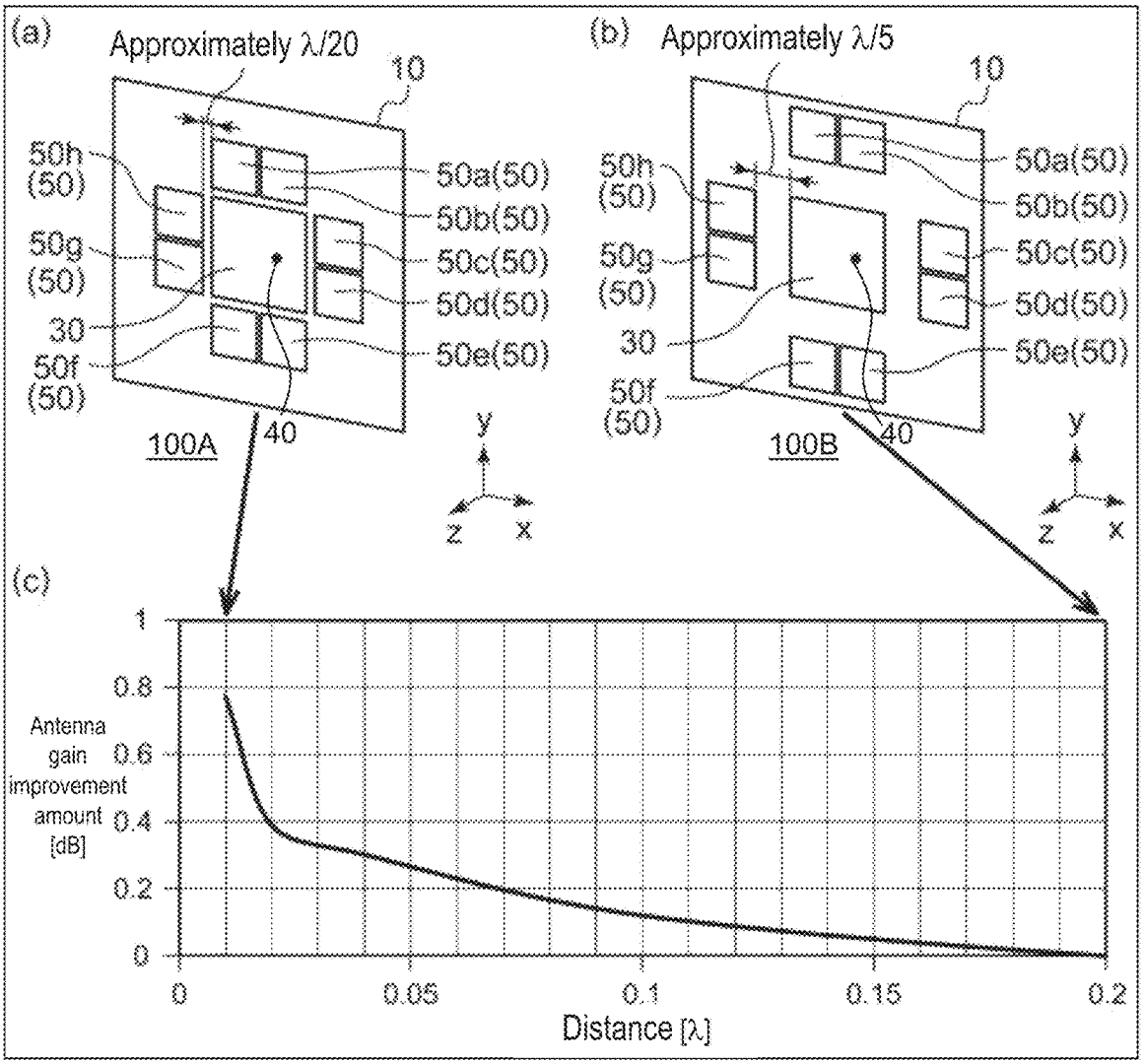
FIG. 7 is a diagram explaining an effect produced by arrangement of the passive elements of the antenna shown in FIG. 1A.

Parts (a) to (c) of FIG. 7 are diagrams each showing an effect produced by arrangement of passive elements 50 of antenna 100A shown in part (d) of FIG. 6. Described herein is an effect produced by the distance between feed element 30 and each of passive elements 50. In part (a) of FIG. 7, the distance between feed element 30 and each of passive elements 50 is set to a length of approximately 1/20 of wavelength λ at the resonance frequency of antenna 100A. In part (b) of FIG. 7, the distance between feed element 30 and each of passive elements 50 is set to a length of approximately ⅕ of wavelength λ at a resonance frequency of antenna 100B. The resonance frequency of antenna 100B is set to a frequency identical to the resonance frequency of antenna 100A.

Part (c) of FIG. 7 shows an effect produced by arrangement of passive elements 50. A horizontal axis represents a distance indicated by wavelength λ, while a vertical axis represents an antenna gain improvement amount with respect to antenna gain when passive elements 50 are not disposed. The length of the outer edge of each of passive elements 50 on the side facing feed element 30 is set to ¼ of wavelength λ at the resonance frequency of antenna 100A. As apparent from part (c) of FIG. 7, the antenna gain improvement amount decreases as the distance increases. Accordingly, it is preferable that the distance between feed element 30 and each of the plurality of passive elements 50 is set to a length smaller than 1/10 of the wavelength at the resonance frequency of antenna 100A.

Figure 8:
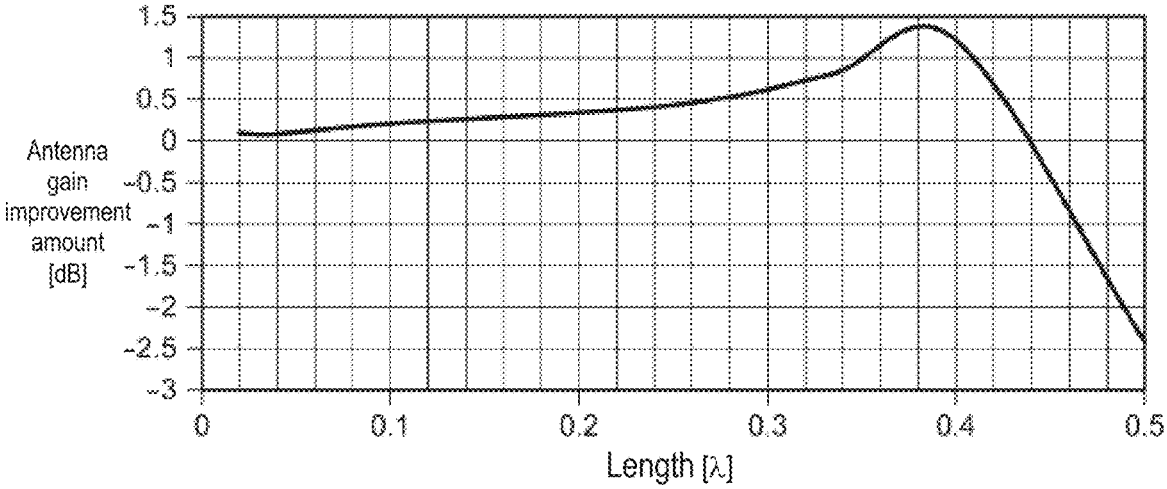
FIG. 8 is a diagram explaining an effect produced by each size of the passive elements of the antenna shown in FIG. 1A.

Next described is an effect produced by the length of the outer edge of each of passive elements 50 on the side not facing feed element 30. This length corresponds to a length in the Y axis direction of first passive element 50*a* of antenna 100A shown in part (d) of FIG. 6, for example. FIG. 8 shows an effect produced by a size of each of passive elements 50. A horizontal axis represents a length of an outer edge of each of passive elements 50 on the side not facing feed element 30, indicating the length by wavelength λ. A vertical axis represents an antenna gain improvement amount with respect to the corresponding amount of the case where passive elements 50 are not disposed. The distance between feed element 30 and each of passive elements 50 is set to a length of 1/50 of wavelength λ at the resonance frequency of antenna 100A. The length of the outer edge of each of passive elements 50 on the side facing feed element 30 is set to a length of ¼ of wavelength λ at the resonance frequency of antenna 100. As apparent from FIG. 8, the antenna gain improvement amount increases as the outer edge of each of passive elements 50 on the side not facing feed element 30 increases. When the length is 0.38λ, the antenna gain improvement amount becomes the maximum. The antenna gain improvement amount rapidly decreases as the length approaches ½ of wavelength λ.

When the length of the outer edge of each of passive elements 50 on the side not facing feed element 30 is approximately ¼ of wavelength λ, passive element 50 does not resonate in a desired band. In this case, an electric field equivalently concentrates on a portion near feed element 30 as a part of feed element 30. When the length becomes approximately ½ of wavelength λ, passive elements 50 operate as an antenna resonating in the desired band. In this case, the electric field intensively distributes also in passive elements 50 and affects a current distribution, and further causes disturbance of the radiation pattern or affects impedance of the antenna. These phenomena produce characteristics shown in FIG. 8. Accordingly, the length of the outer edge of each of passive elements 50 on the side not facing feed element 30 is set to a length smaller than the length of feed element 30 at least either in the X axis direction or the Y axis direction. Based on FIG. 8, the foregoing length is set to a length more than or equal to ⅕ of the wavelength at the resonance frequency of antenna 100A. The lengths of passive elements 50 may be set in this manner.

Another effect produced by the arrangement and size of passive elements 50 is now described with reference to FIG. 9. Antenna 170D shown in part (a) of FIG. 9 corresponds to antenna 170A shown in part (a) of FIG. 6, while antenna 170E shown in part (b) of FIG. 9 corresponds to antenna 170C shown in part (c) of FIG. 6. Antenna 100C shown in part (c) of FIG. 9 corresponds to antenna 100A shown in part (d) of FIG. 6. The length of feed element 130 of antennas 170D, 170E, 100C, and 100D in the X axis direction or the Y axis direction is set to a length smaller than ½ of wavelength λ at the resonance frequency of antenna 170 similarly to the corresponding length of antenna 100A.

Antenna 100D includes seventh passive element 50*g* and eighth passive element 50*h* in addition to components of antenna 100C. More specifically, seventh passive element 50*g* is disposed in contact with corner C1 of feed element 30 on the positive side in the X axis direction and on the positive side in the Y axis direction. In addition, eighth passive element 50*h* is disposed in contact with corner C2 of feed element 30 on the positive side in the X axis direction and on the negative side in the Y axis direction. More specifically, second passive element 50*b*, seventh passive element 50*g*, and third passive element 50*c* are so disposed as to surround corner C1 of feed element 30, while fourth passive element 50*d*, eighth passive element 50*h*, and fifth passive element 50*e* are so disposed as to surround corner C2 of feed element 30. According to antenna 100D, therefore, the number of passive elements 50 is larger than that number of antenna 100C, wherefore a total element area of passive elements 50 increases.

Figure 9:
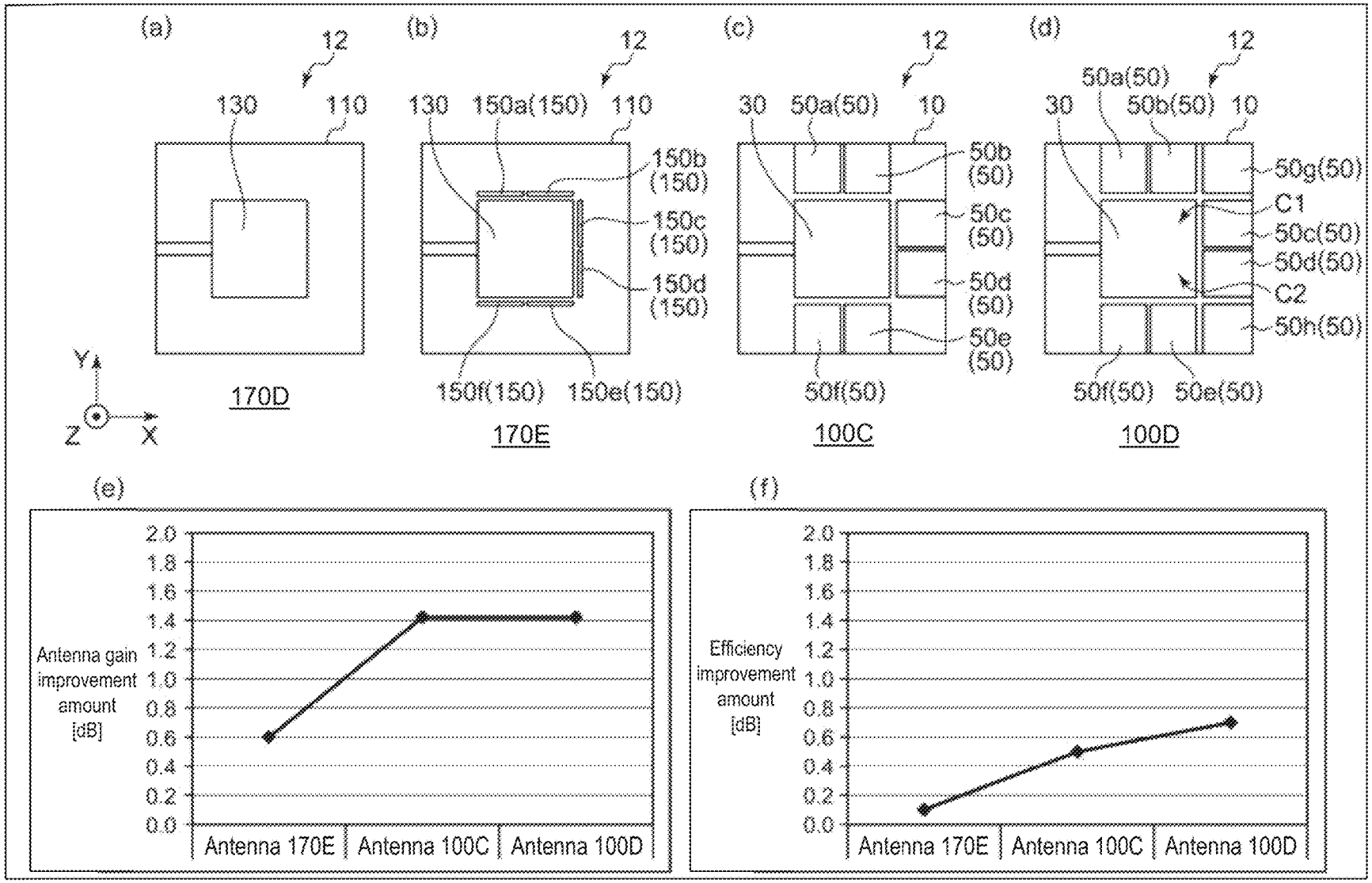
FIG. 9 is a diagram explaining an effect produced by arrangement and each size of the passive elements of the antenna shown in FIG. 1A.

Part (e) of FIG. 9 shows an antenna gain improvement amount of each of antenna 170E, antenna 100C, and antenna 100D with respect to that amount of antenna 170D. Part (f) of FIG. 9 shows an efficiency improvement amount of each of antenna 170E, antenna 100C, and antenna 100D with respect to that amount of antenna 170D. The antenna gain improvement amount and the efficiency improvement amount of antenna 100C are larger than those amounts of antenna 170E. The antenna gain improvement amount of antenna 100D is approximately equivalent to the antenna gain improvement amount of antenna 100C. However, the efficiency improvement amount of antenna 100D is larger than the efficiency improvement amount of antenna 100C. The antenna gain and efficiency improve by enlargement of the element area of passive elements 50.

Another effect produced by the size of passive elements 50 is now described with reference to FIG. 10. Antenna 100E shown in part (a) of FIG. 10 has a structure which includes passive elements 50 included in antenna 100D in part (d) of FIG. 9 and each having a shape similar to the shape of passive elements 50 shown in FIG. 1A. As described above, the length of the outer edge of each of passive elements 50 on the side facing feed element 30 is set to a length smaller than the length of feed element 30 in the direction identical to the direction of this outer edge. Accordingly, each of the lengths of first passive element 50*a* and fifth passive element 50*e* in the X axis direction is smaller than the length of feed element 30 in the X axis direction, while the length of third passive element 50*c* in the Y axis direction is smaller than the length of passive element 30 in the Y axis direction.

Figure 10:
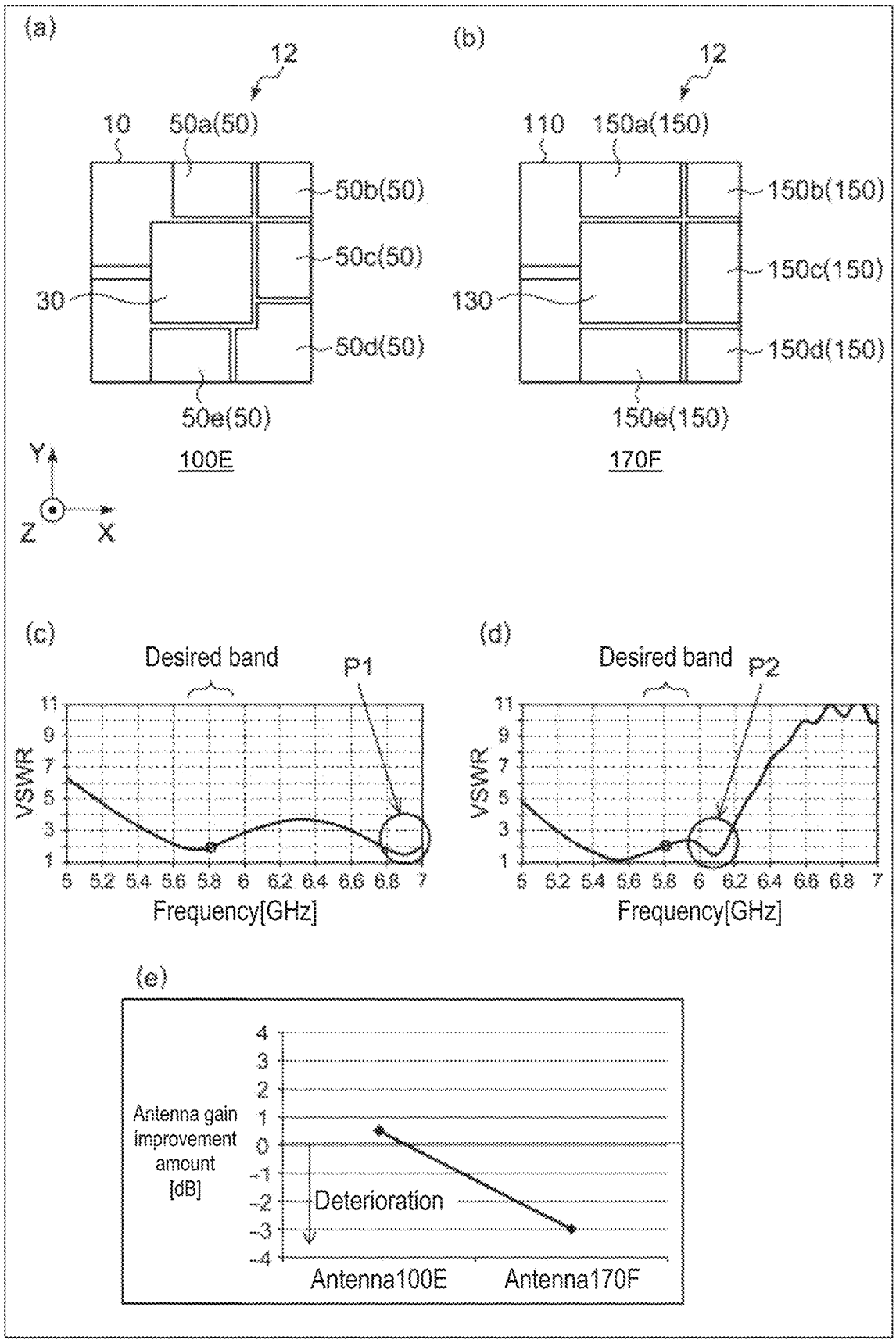
FIG. 10 is a diagram explaining another effect produced by each size of the passive elements of the antenna shown in FIG. 1A.

Antenna 170F shown in part (b) of FIG. 10 is a comparison target of antenna 100E. In case of antenna 170F, the length of the outer edge of each of passive elements 150 on the side facing feed element 130 is set to a length equal to the length of feed element 130 in the direction identical to the direction of this outer edge. More specifically, each of the lengths of first passive element 150*a* and fifth passive element 150*e* in the X axis direction is equal to the length of feed element 130 in the X axis direction, while the length of third passive element 150*c* in the Y axis direction is equal to the length of passive element 130 in the Y axis direction.

Part (c) of FIG. 10 shows a VSWR of antenna 100E when a frequency changes. Passive elements 50 resonate near P1. The frequency at P1 is away from a desired band, and therefore does not affect a VSWR in the desired band. Part (d) of FIG. 10 shows a VSWR of antenna 170F when a frequency changes. Passive elements 150 resonate near P2, i.e., resonate at a frequency near the resonance frequency of feed element 130. Accordingly, the VSWR in the desired band lowers by resonance of passive elements 150. Part (e) of FIG. 10 shows an antenna gain improvement amount in the desired band with respect to antennas 100E and 170F. An antenna gain improvement amount smaller than 0 dB indicates deterioration of characteristics. The antenna gain improvement amount of antenna 100E is larger than the antenna gain improvement amount of antenna 170F for a reason similar to the reason described above.

Figure 11A:
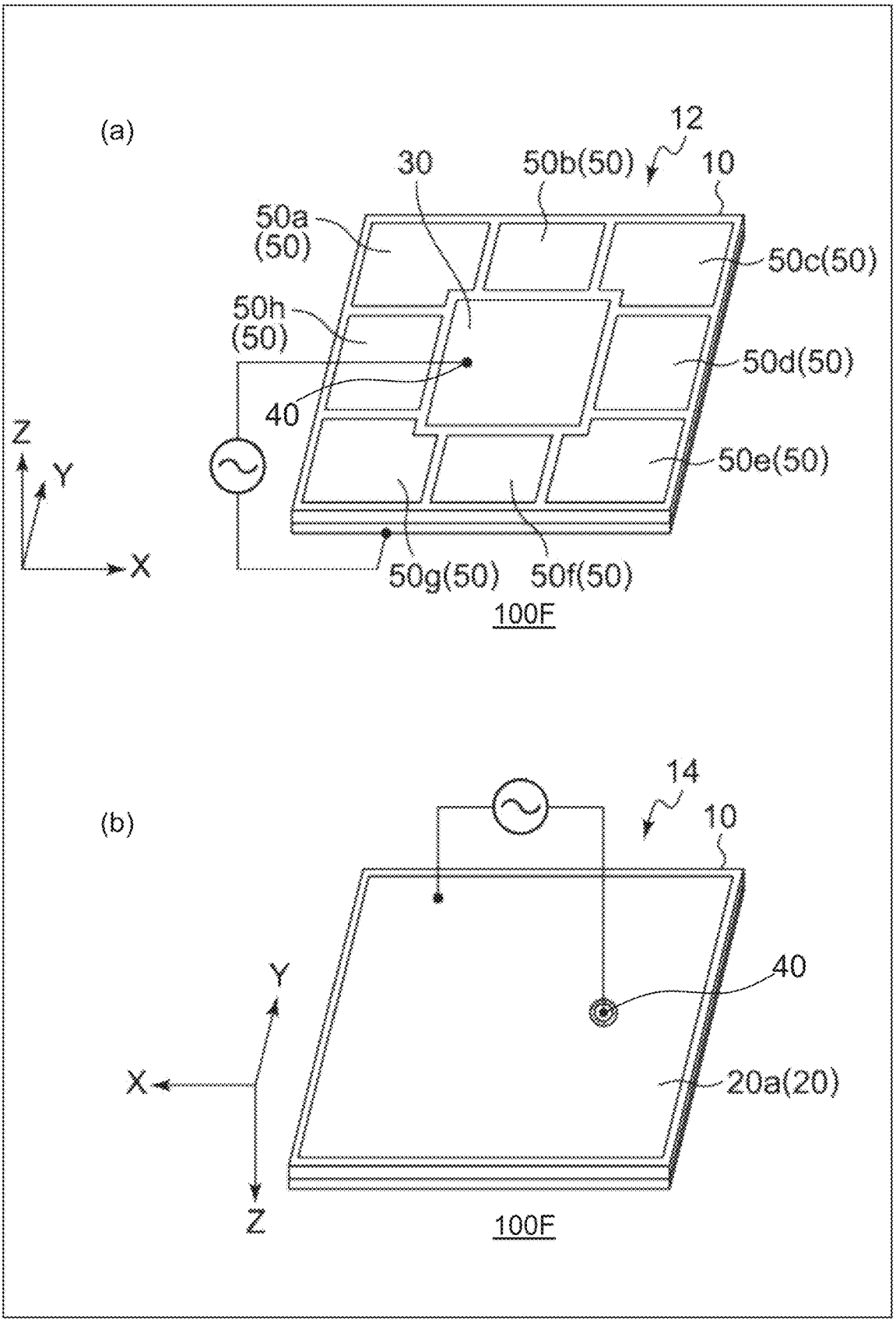
FIG. 11A is a perspective view showing another structure of the antenna according to the exemplary embodiment of the present disclosure.
Figure 11B:
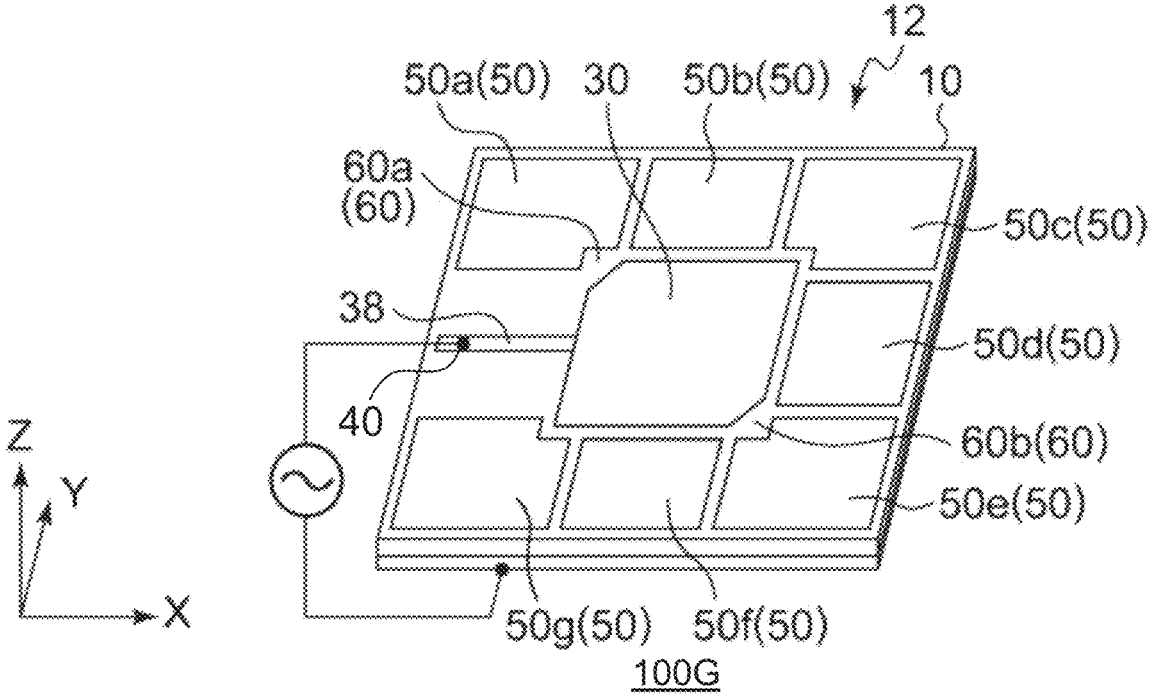
FIG. 11B is a perspective view showing a further structure of the antenna according to the exemplary embodiment of the present disclosure.
Figure 11C:
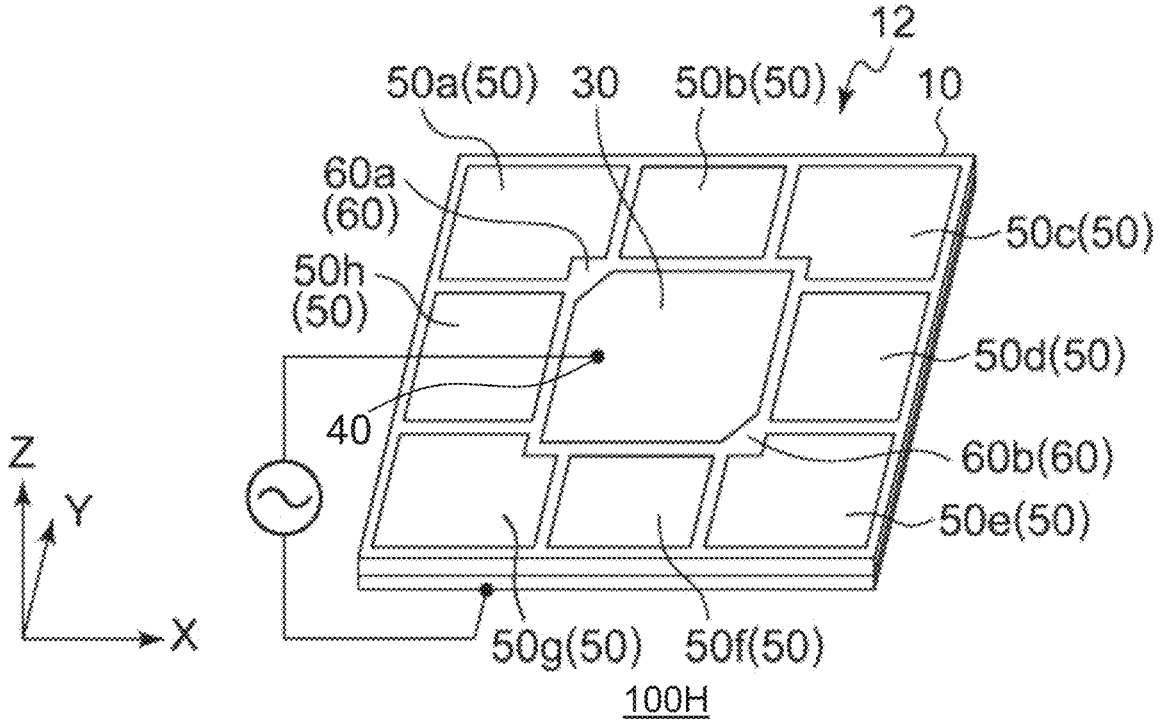
FIG. 11C is a perspective view showing a still further structure of the antenna according to the exemplary embodiment of the present disclosure.

Various modified examples of antenna 100 are hereinafter described. FIGS. 11A to 11C are perspective views each showing a different configuration of antenna 100. Part (a) of FIG. 11A is a perspective view of antenna 100F according to a first modified example as viewed from front surface 12, while part (b) of FIG. 11A is a perspective view of antenna 100F as viewed from rear surface 14. Antenna 100F does not include microstrip line 38, and feeds power from rear surface 14 to feed element 30 via feed point 40.

FIG. 11B is a perspective view of antenna 100G according to a second modified example as viewed from front surface 12, while FIG. 11C is a perspective view of antenna 100H according to a third modified example as viewed from front surface 12. First perturbation portion 60*a* and second perturbation portion 60*b* are provided at corners facing each other on a diagonal line of feed element 30 of each of antennas 100G and 100H. Each of first perturbation portion 60*a* and second perturbation portion 60*b* is collectively referred to as perturbation portion 60, and has a corner cut-off shape of feed element 30. A circularly polarized wave is produced by perturbation portions 60 as a radio wave radiated from antenna 100. Antenna 100G includes microstrip line 38. Antenna 100H does not include microstrip line 38, and feeds power from rear surface 14 to feed element 30 via feed point 40.

Figure 12A:
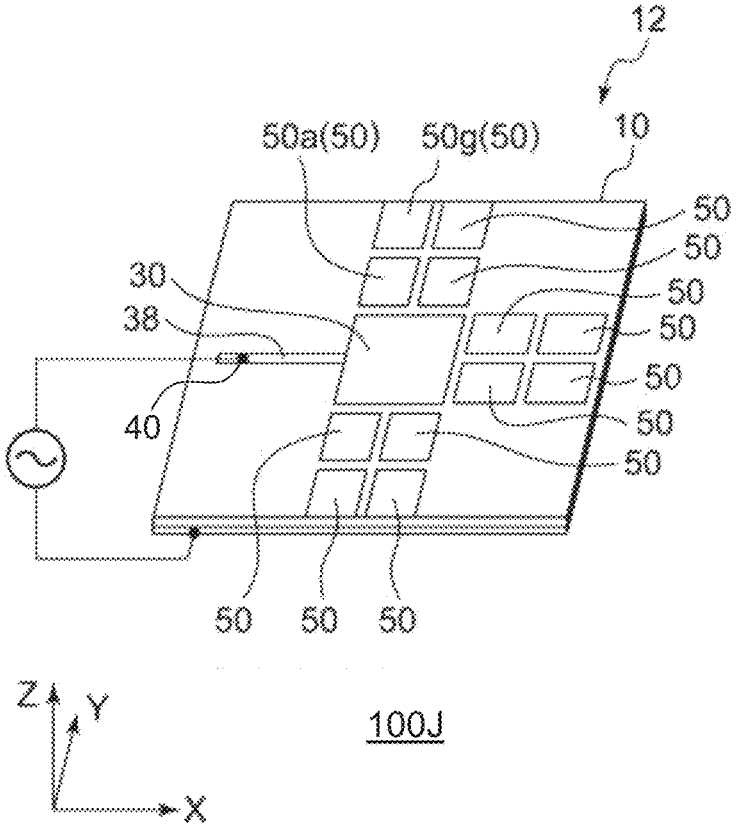
FIG. 12A is a perspective view showing a still further structure of the antenna according to the exemplary embodiment of the present disclosure.
Figure 12B:
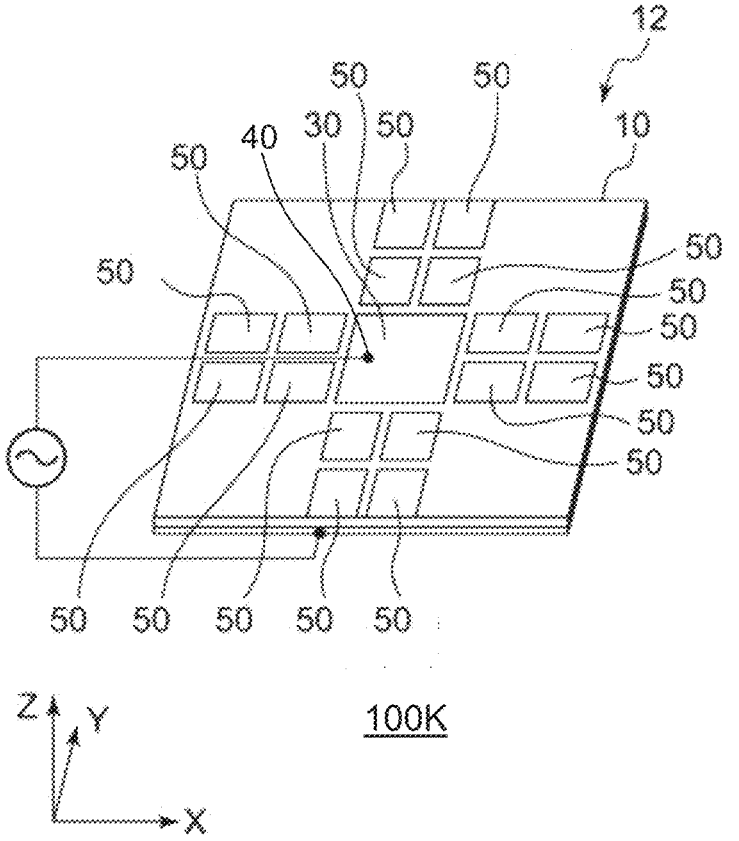
FIG. 12B is a perspective view showing a still further structure of the antenna according to the exemplary embodiment of the present disclosure.

FIG. 12A is a perspective view showing a structure of antenna 100J according to a fourth modified example, while FIG. 12B is a perspective view showing a structure of antenna 100K according to a fifth modified example. In the antennas described above, the plurality of passive elements 50 are disposed in a single line in the X axis and Y axis directions at least on a part around feed element 30. In case of antennas 100J and 100K, however, a plurality of passive elements 50 are disposed in double lines in the X axis and Y axis directions at least on a part around feed element 30. For example, in case of antenna 100J, two passive elements 50 constituted by first passive element 50*a* and seventh passive element 50*g* are disposed side by side from feed element 30 toward the positive side in the Y axis direction. According to this structure, passive elements 50 reaches a vicinity of an end of dielectric substrate 10, wherefore antenna gain improves. Antenna 100J includes microstrip line 38. Antenna 100K does not include microstrip line 38, and feeds power from rear surface 14 to feed element 30 via feed point 40.

(3) Structure Including Second Region 26

Figure 13:
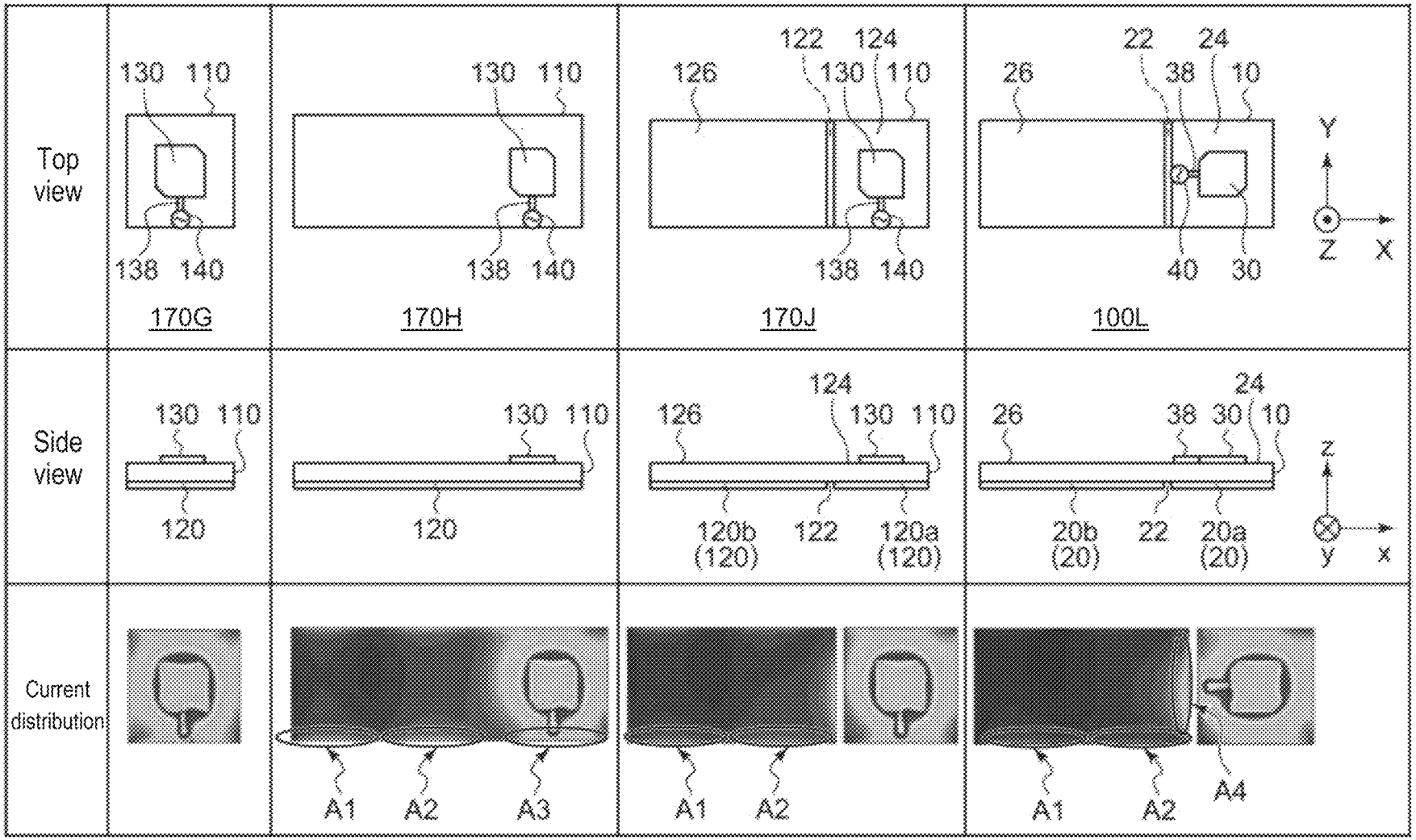
FIG. 13 is a diagram explaining an effect produced by arrangement of a feeding point and a slit of the antenna shown in FIG. 1A.

In the above description, second region 26 is eliminated from antenna 100 shown in FIG. 1A. Described hereinafter is a structure of an antenna including second region 26. FIG. 13 shows arrangement of feed point 40 and slit 22, and an effect produced by the arrangement. Four structures are described herein. Antennas 170G to 170J are comparison targets of antenna 100L. Antenna 170G has a structure similar to the structure of antenna 170A shown in part (a) of FIG. 6, and the structure of antenna 170D shown in part (a) of FIG. 9. Microstrip line 138 extends from feed element 130 toward the negative side in the Y axis direction. An end of microstrip line 138 opposite to the end connected to feed element 130 is connected to feed point 140. Ground element 120 is disposed on a surface of dielectric substrate 110 on the side opposite to the surface where feed element 130 is provided. Ground element 120, microstrip line 138, and feed point 140 correspond to ground element 20, microstrip line 38, and feed point 40 of antenna 100, respectively. As described above, antenna directivity toward the Zenith is produced by a current distribution of antenna 170G.

Dielectric substrate 110 of antenna 170H has a shape longer in the X axis direction than in the Y axis direction similarly to dielectric substrate 10 in FIG. 1A. Similarly, ground element 120 has a shape longer in the X direction in correspondence with the shape of dielectric substrate 110. In a current distribution of antenna 170H, ground current A3 near feed point 140 flows toward the negative side in the X axis direction along the outer edge of dielectric substrate 110 extending in the X axis direction (ground currents A1, A2). As described above, distance from a radiation end of the antenna element to a diffraction end of the ground element becomes non-uniform in radiation of radio waves from ground currents A1, A2, and A3. Accordingly, components cancelling each other in phase are produced. As a result, antenna directivity toward the Zenith collapses, wherefore antenna gain in the Zenith direction decreases.

Dielectric substrate 110 of antenna 170J has a shape identical to a shape of dielectric substrate 110 of antenna 170H. First ground element 120*a* and second ground element 120*b* are disposed in place of ground element 120. First ground element 120*a* and second ground element 120*b* are separated from each other with slit 122 located at a boundary between first and second ground elements 120*a* and 120*b*, and have ground potentials different from each other. First region 124 corresponds to a rear side of a portion where first ground element 120*a* is provided, while second region 126 corresponds to a rear side of a portion where second ground element 120*b* is provided. First ground element 120*a*, second ground element 120*b*, slit 122, first region 124, and second region 126 correspond to first ground element 20*a*, second ground element 20*b*, slit 22, first region 24, and second region 26 of antenna 100, respectively. As described above, first ground element 120*a* and second ground element 120*b* are separated by slit 122. Accordingly, in a current distribution of antenna 170J, ground currents A1, A2 flowing toward the negative side in the X axis direction along the outer edge of dielectric substrate 110 extending in the X axis direction become smaller than ground currents A1, A2 of antenna 170H. As a result, components cancelling each other decrease, wherefore collapse of antenna directivity toward the Zenith is reduced.

Antenna 100L corresponds to a structure of antenna 100 shown in FIG. 1A from which passive elements 50 are eliminated. Microstrip line 38 extends from feed element 30 toward the negative side in the X axis direction. An end of microstrip line 38 opposite to the end connected to feed element 30 is connected to feed point 40. In a current distribution of antenna 100L, feed point 40 is disposed near slit 22. Accordingly, ground current A4 near slit 22 increases. However, ground currents A1, A2 flowing toward the negative side in the X axis direction along the outer edge of dielectric substrate 10 extending in the X axis direction become smaller than ground currents A1, A2 of antenna 170J. As a result, components cancelling each other further decreases, wherefore collapse of antenna directivity toward the Zenith is further reduced. Accordingly, antenna gain in the Zenith direction approaches antenna gain of antenna 170G.

According to the present exemplary embodiment described above, the circuit section is surrounded by the feed element. Accordingly, disturbance of input characteristics and radiation characteristics can be reduced even when the circuit section is disposed. Antenna characteristics (antenna gain and antenna efficiency) can improve by reduction of disturbance of input characteristics and radiation characteristics. Electric connection between the ground element and the land can be made by providing the through hole. The diameter of the hole is set to a length less than or equal to ⅛ of the wavelength at the resonance frequency of the present antenna. Accordingly, an effect on the electromagnetic field of the antenna can be reduced. An effect of the hole also decreases by reduction of the effect on the electromagnetic field of the antenna. The diameter of the hole is set to a length less than or equal to ⅛ of the wavelength at the resonance frequency of the antenna, wherefore high input characteristics and radiation characteristics can be maintained. The effect of the hole also decreases by maintaining the high input characteristics and radiation characteristics.

The circuit section has a high impedance, wherefore high-frequency separation between the feed element and the ground element can be made. Disturbance of input characteristics and radiation characteristics can be reduced by high-frequency separation between the feed element and the ground element. The hole is formed within the range from the center of the feed element to the length less than or equal to 1/20 of the wavelength at the resonance frequency of the present antenna, wherefore a change of the resonance frequency of the antenna can be reduced. Disturbance of input characteristics and radiation characteristics decreases by reduction of the change of the resonance frequency of the antenna. The circuit section is formed as a stub pattern. Accordingly, the number of circuit parts can be reduced while maintaining the antenna characteristics. Cost reduction is also achievable by reduction of the number of circuit parts.

The length of the feed element is smaller than ½ of the wavelength at the resonance frequency of the antenna, and the length of each of the passive elements is smaller than the length of the feed element. Accordingly, resonance between the feed element and the passive elements at the resonance frequency can be reduced. Antenna characteristics can improve by reduction of resonance between the feed element and the passive elements at the resonance frequency. The clearance between each of the passive elements and the feed element is smaller than 1/10 of the wavelength at the resonance frequency of the present antenna. Accordingly, the passive elements are usable as reflection plates. Antenna characteristics can improve by the use of the passive elements as reflection plates. The length of the outer edge of each of the passive elements on the side not facing the feed element is smaller than the length of the feed element. Accordingly, resonance between the feed element and the passive elements at the resonance frequency can be reduced. The length of the outer edge of each of the passive elements on the side not facing the feed element is a length more than or equal to ⅕ of the wavelength at the resonance frequency of the present antenna. Accordingly, antenna characteristics can improve. The passive elements are so disposed as to surround the corners of the feed element. Accordingly, the element area increases. The perturbation portions additionally provided allow handling of a circularly polarized wave.

The ground element includes the slit, and the feed element is disposed on the slit side. Accordingly, the ground current can be reduced. Radiation of components cancelling each other in phase are reduced by reduction of the ground current. Antenna characteristics can improve by reduction of radiation of components cancelling each other. The width of the slit is increased by a certain amount, wherefore the ground current flowing in the second ground element can be reduced. Antenna characteristics in the Zenith direction can improve by reduction of the ground current flowing in the second ground element. The ground potential is divided into the first ground element and the second ground element. Accordingly, the antenna characteristics can improve by reduction of such a ground current which radiates components cancelling each other. The electric circuit section is mounted on a region overlapping with the second ground element. Accordingly, use applications of the antenna can be widened.

The present disclosure has been described above according to the exemplary embodiment. It will be understood by those skilled in the art that the exemplary embodiment is merely an example; that other exemplary modifications, in which components of the exemplary embodiment are variously combined, are possible; and that the other exemplary modifications still fall within the scope of the present disclosure.

An outline of one aspect of the present disclosure is as follows.

(Item 1-1)

An antenna characterized by comprising:

a dielectric substrate;

a ground element disposed on a first surface side of the dielectric substrate;

a feed element disposed on a second surface side of the dielectric substrate;

a hole disposed inside the feed element;

a land disposed inside the hole; and a circuit section disposed between the feed element and the land.

According to this aspect, the circuit section is disposed at a position not affecting input impedance, wherefore antenna characteristics can improve.

(Item 1-2)

The antenna according to Item 1-1, characterized by further comprising a through hole that penetrates the dielectric substrate, and connects the ground element and the land. In this case, electric connection between the ground element and the land can be made via the through hole.

(Item 1-3)

The antenna according to Item 1-1 or Item 1-2, characterized in that a diameter of the hole is less than or equal to ⅛ of a wavelength at a resonance frequency of the present antenna. In this case, the diameter of the hole is set to a length less than or equal to ⅛ of the wavelength at the resonance frequency of the present antenna. Accordingly, an effect of the hole can be reduced.

(Item 1-4)

The antenna according to any one of Items 1-1 to 1-3, characterized in that the hole is formed in a range from a center of the feed element to 1/20 of the wavelength at the resonance frequency of the present antenna. In this case, the hole is formed in the range from the center of the feed element to 1/20 of the wavelength at the resonance frequency of the present antenna. Accordingly, the effect of the hole can be reduced.

(Item 1-5)

The antenna according to any one of Items 1-1 to 1-4, characterized in that the circuit section is formed as a stub pattern. In this case, the circuit section is formed as a stub pattern, wherefore the number of circuit parts can be reduced.

(Item 2-1)

An antenna characterized by comprising:

a dielectric substrate;

a feed element disposed on one surface side of the dielectric substrate; and a plurality of passive elements disposed around the feed element.

A length of the feed element at least in one of directions of two outer edges included in the feed element and crossing each other is smaller than ½ of the wavelength at the resonance frequency of the present antenna. A length of an outer edge of each of the plurality of passive elements on a side facing the feed element is smaller than the length of the feed element.

According to this aspect, the length of the feed element is smaller than ½ of the wavelength at the resonance frequency of the present antenna, and the length of each of the passive elements is smaller than the length of the feed element. Accordingly, antenna characteristics can improve.

(Item 2-2)

The antenna according to Item 2-1, characterized in that a clearance between the feed element and each of the plurality of passive elements is smaller than 1/10 of the wavelength at the resonance frequency of the present antenna. In this case, the clearance between the feed element and each of the passive elements is smaller than 1/10 of the wavelength at the resonance frequency of the present antenna. Accordingly, the passive elements are usable as reflection plates.

(Item 2-3)

The antenna according to Item 2-1 or Item 2-2, characterized in that a length of an outer edge of each of the plurality of passive elements on a side not facing the feed element is smaller than the length of the feed element. In this case, the length of the outer edge of each of the passive elements on the side not facing the feed element is smaller than the length of the feed element. Accordingly, antenna characteristics can improve.

(Item 2-4)

The antenna according to Item 2-3, characterized in that the length of the outer edge of each of the plurality of passive elements on the side not facing the feed element is a length more than or equal to ⅕ of the wavelength at the resonance frequency of the present antenna. In this case, the length of the outer edge of each of the passive elements on the side not facing the feed element is a length more than or equal to ⅕ of the wavelength at the resonance frequency of the present antenna. Accordingly, antenna characteristics can improve.

(Item 2-5)

The antenna according to any one of Items 2-1 to 2-4, characterized in that the plurality of passive elements are so disposed as to surround a corner of the feed element. In this case, the passive elements are so disposed as to surround the corner of the feed element. Accordingly, the element area increases.

(Item 3-1)

An antenna characterized by comprising:

a dielectric substrate;

a ground element disposed on a first surface side of the dielectric substrate;

a slit formed in the ground element;

a feed element disposed on a second surface side of the dielectric substrate; and a feed point connected to the feed element.

The feed point is disposed on the slit side with respect to the feed element.

According to this aspect, the slit is formed in the ground element, and the feed element is disposed on the slit side. Accordingly, such a ground current which radiates components cancelling each other in phase decreases, wherefore antenna characteristics can improve.

(Item 3-2)

The antenna according to Item 3-1, characterized in that the ground element includes:

a first ground element; and a second ground element whose ground potential is separated from that of the first ground element with the slit located at a boundary between the first and second ground elements.

The first ground element is so disposed as to overlap with the feed element on a projection surface parallel to the first surface or the second surface. In this case, the ground potential is divided into the first ground element and the second ground element. Accordingly, the antenna characteristics can improve by reduction of the ground current which radiates components cancelling each other.

(Item 3-3)

The antenna according to Item 3-2, characterized by further comprising an electric circuit section formed on the second surface side of the dielectric substrate. The electric circuit section is so disposed as to overlap with the second ground element on a projection surface parallel to the first surface or the second surface. In this case, the electric circuit section is mounted on a region overlapping with the second ground element. Accordingly, applications of the antenna can be widened.

In the exemplary embodiment of the present disclosure, hole 32 and land 34 are formed on feed element 30. Circuit section 36 is connected to feed element 30. However, other configurations may be adopted. For example, hole 32, land 34, and circuit section 36 may be eliminated. According to this modification, the structure of antenna 100 can be simplified.

In the exemplary embodiment of the present disclosure, the plurality of passive elements 50 are disposed around feed element 30. However, other configurations may be adopted. For example, the plurality of passive elements 50 may be eliminated. According to this modification, the structure of antenna 100 can be simplified.

In the exemplary embodiment of the present disclosure, second ground element **20*b*, second region 26, and electric circuit section 42 are disposed on dielectric substrate 10. However, other configurations may be adopted. For example, second ground element 20*b*, second region 26, and electric circuit section 42 may be eliminated. In this case, dielectric substrate 10 has a substantially square shape. According this modification, the structure of antenna 100** can be simplified.

In the present exemplary embodiment, slit 22 is so formed as to penetrate dielectric substrate 10 in the Y axis direction. However, other configurations may be adopted. For example, slit 22 need not penetrate dielectric substrate 10 in the Y axis direction. In this case, connection between a part of first ground element **20*a* and a part of second ground element 20*b*** is made. This modification can improve the degree of freedom in the structure.

In the exemplary embodiment of the present disclosure, antenna 100 is used in an ETC on-vehicle device. The resonance frequency of antenna 100 is set to a frequency in the band of 5.8 GHz. However, other configurations may be adopted. For example, the use applications and the resonance frequency of antenna 100 may be set otherwise. According to this modification, a range of applications of antenna 100 can be widened.

The antenna of the present disclosure is useful when applied to a communication device such as an on-vehicle device including an ETC on-vehicle device.

What is claimed is:

1. An antenna comprising:

a dielectric substrate;

a ground element that is disposed on a first surface of the dielectric substrate and includes a slit;

a feed element that is disposed on a second surface of the dielectric substrate;

a microstrip line that extends from the feed element toward the slit; and a feed point that is disposed on the second surface of the dielectric substrate, and connected to the feed element via the microstrip line, wherein the feed point is positioned between the feed element and the slit, and disposed at an end of the microstrip line, the ground element includes;

a first ground element; and a second ground element separated from the first ground element with the slit located at a boundary between the first and second ground elements, and the first ground element overlaps with the feed element on a projection surface parallel to the first surface or the second surface.

2. The antenna according to claim 1, further comprising an electric circuit section disposed on the second surface of the dielectric substrate, wherein the electric circuit section overlaps with the second ground element on the projection surface parallel to the first surface or the second surface.

3. An antenna comprising:

a dielectric substrate;

a ground element that is disposed on a first surface of the dielectric substrate and includes a slit;

a feed element that is disposed on a second surface of the dielectric substrate, a hole is disposed inside the feed element, a land is disposed inside the hole;

a circuit section is disposed between the feed element and the land, a microstrip line that extends from the feed element toward the slit; and a feed point that is disposed on the second surface of the dielectric substrate, and connected to the feed element via the microstrip line, wherein the feed point is positioned between the feed element and the slit, and disposed at an end of the microstrip line.

4. The antenna according to claim 3, further comprising a through hole that penetrates the dielectric substrate, and connects the ground element and the land.

5. The antenna according to claim 3, wherein a diameter of the hole is less than or equal to ⅛ of a wavelength at a resonance frequency of the antenna.

6. The antenna according to claim 5, wherein the hole is formed in such a position that a distance between the hole and a center of the feed element is included in a range of less than or equal to 1/20 of the wavelength at the resonance frequency of the antenna.

7. The antenna according to claim 3, wherein the hole is formed in such a position that a distance between the hole and a center of the feed element is included in a range of less than or equal to 1/20 of a wavelength at a resonance frequency of the antenna.

8. The antenna according to claim 3, wherein the circuit section is formed as a stub pattern.

9. An antenna comprising:

a dielectric substrate;

a ground element that is disposed on a first surface of the dielectric substrate and includes a slit;

a feed element that is disposed on a second surface of the dielectric substrate;

passive elements disposed on the second surface of the dielectric substrate around the feed element;

a microstrip line that extends from the feed element toward the slit; and a feed point that is disposed on the second surface of the dielectric substrate, and connected to the feed element via the microstrip line, wherein the feed point is positioned between the feed element and the slit, and disposed at an end of the microstrip line, the feed element includes two outer edges that cross each other, a length of the feed element at least in one of two directions along the two outer edges is smaller than ½ of a wavelength at a resonance frequency of the antenna, and a length of an outer edge of at least one of the passive elements on a side facing the feed element is smaller than a length of the feed element in a direction along the outer edge of the at least one of the passive elements.

10. The antenna according to claim 9, wherein a clearance between the feed element and each of the passive elements is smaller than 1/10 of the wavelength at the resonance frequency of the antenna.

11. The antenna according to claim 9, wherein a length of an outer edge of each of the passive elements on a side not facing the feed element is smaller than the length of the feed element at least in one of two directions along the two outer edges of the feed element.

12. The antenna according to claim 11, wherein the length of the outer edge of each of the passive elements on the side not facing the feed element is more than or equal to ⅕ of the wavelength at the resonance frequency of the antenna.

13. The antenna according to claim 9, wherein the plurality of passive elements surround a corner of the feed element.

* * * * *